US005206614A

United States Patent [19]

Carothers

[11] Patent Number: 5,206,614

[45] Date of Patent: Apr. 27, 1993

[54] LINE CONDUCTOR GASKET

[75] Inventor: Arthur D. Carothers, Beaver Falls, Pa.

[73] Assignee: Westinghouse Electric Corp., Pittsburgh, Pa.

[21] Appl. No.: 676,584

[22] Filed: Mar. 28, 1991

[51] Int. Cl.[5] ..... H01H 75/00

[52] U.S. Cl. ..... 335/16; 335/201; 200/147 R

[58] Field of Search ..... 335/6, 16, 147, 195; 200/144 R, 20

[56] References Cited

U.S. PATENT DOCUMENTS 4,654,491 3/1987 Maier et al. ..... 335/195
4,965,418 10/1990 Arnold et al. .
4,970,481 11/1990 Arnold et al. ..... 335/6
4,973,927 11/1990 Carothers et al. .

*Primary Examiner*—Lincoln Donovan
*Attorney, Agent, or Firm*—M. J. Moran

[57] ABSTRACT

A molded gasket for a line conductor in a circuit breaker acts as a gas seal to prevent ionizing gases resulting from a circuit interruption from flashing over and causing phase-to-phase and phase-to-ground faults. The molded gasket includes provisions for sealing the line conductor at the interfaces with the circuit breaker housing as well as providing a barrier for the movable contact arm assembly.

22 Claims, 6 Drawing Sheets

LINE CONDUCTOR GASKET

CROSS REFERENCE TO RELATED APPLICATIONS

The invention disclosed herein relates to molded case circuit breakers. The following patent applications all relate to molded case circuit breakers: Ser. No. 07/226,503, entitled CROSS-BAR ASSEMBLY, by Jere L. McKee, Lance Gula and Glenn R. Thomas, filed Aug. 1, 1988 now U.S. Pat. No. 5,057,806.

The following commonly assigned U.S. patent applications all filed on Oct. 12, 1988 and all relating to molded case circuit breakers: Ser. No. 07/256,881 entitled SCREW ADJUSTABLE CLINCH JOINT WITH BOSSES, by James N. Altenhof, Ronald W. Crookston, Walter V. Bratkowski, and J. Warren Barkell, since abandoned; and Ser. No. 07/256,878, entitled TWO-PIECE CRADLE LATCH FOR CIRCUIT BREAKER, by Alfred E. Maier and William G. Eberts, since abandoned.

The following commonly owned patent application filed on Apr. 25, 1989: Ser. No. 07/343,047, entitled TWO-PIECE CRADLE LATCH, KEY BLOCKS AND SLOT MOTOR FOR CIRCUIT BREAKER, by Alfred E. Maier, William G. Eberts and Richard E White, now U.S. Pat. No. 5,027,096. Commonly owned patent application Ser. No. 343,820, filed on Apr. 25, 1989, entitled HANDLE BARRIER LOCKING INSERT, by A. D. Carothers, D. A. Parks, R. E. White and W. G. Eberts, now U.S. Pat. No. 4,973,927.

Commonly owned patent application Ser. No. 07/374,370 filed on Jun. 30, 1989, entitled REVERSE SWITCHING MEANS FOR MOTOR OPERATOR, by Kurt Grunert and Charles Paton, now U.S. Pat. No. 4,990,873.

Commonly owned patent application Ser. No. 07/491,329, filed on Mar. 9, 1990, entitled PINNED SHUNT END EXPANSION JOINT, by Lance Gula and Roger W. Helms, now U.S. Pat. No. 5,032,813.

Commonly owned patent application Ser. No. 07/503,812 was filed on Apr. 3, 1990, entitled CIRCUIT BREAKER POSITIVE OFF LINK, by David A. Parks, Thomas A. Whitaker and Y. W. Chou.

Commonly owned patent application Ser. No. 07/543,985 filed on Jun. 26, 1990, entitled PHASE SENSITIVITY, by Stephen Mrenna, L. M. Hapeman, John A. Wafer, Robert J. Tedesco, Kurt A. Grunert and Henry A. Wehrli III.

Commonly owned patent application Ser. No. 07/574,978 was filed on Aug. 30, 1990, entitled E FRAME PANCAKE DESIGN, by Kurt A. Grunert, John A. Wafer, H. A. Wehrli III and L. M. Hapeman.

BACKGROUND OF THE INVENTION

1. Field of the Invention

This invention relates to molded case circuit breakers and more particularly to a gasket for a line conductor within a circuit breaker which assists in channeling conductive ionized gases resulting from a circuit interruption to designated vents in the circuit breaker housing to prevent such gases from flashing over and causing phase-to-phase and phase-to-ground faults.

2. Description of the Prior Art

Molded case circuit breakers are generally old and well known in the art. An example of such a circuit breaker is disclosed in U.S. Pat. No. 4,973,927. Such a circuit breaker is used to protect electrical circuitry from damage due to an overcurrent condition, such as an overload and relatively high level short circuit condition. An overload condition is normally about 200-300 percent of the nominal current rating of the circuit breaker. A high level short circuit condition can be 1000 percent or more of the nominal current rating of the circuit breaker.

Molded case circuit breakers include at least one pair of separable contacts which may be operated either manually by way of a handle disposed on the outside of the case or automatically in response to an overcurrent condition. In the automatic mode of operation, the contacts may be opened by an operating mechanism, controlled by a trip unit, or blown open by magnetic repulsion forces generated between the stationary and movable contacts during relatively high levels of overcurrent.

Ionizing gases are generated within the circuit breaker as a result of a separation of the main contacts. Since such gases are conductive, communication of such gases between phases or between phase and ground can cause segregated and generally channeled through arc extinguishers and vented out the circuit breaker.

In order to segregate such ionizing gases, each pole of a multipole circuit breaker is segregated within the circuit breaker by way of interior sidewalls, known as interphase gas barriers, defining one or more phase compartments. An arc extinguisher is disposed in each phase compartment adjacent the separable main contacts. The arc extinguishers are typically formed with a plurality of parallel plates, carried by a frame which includes a rear wall and two sidewalls. The rear wall is provided with a plurality of vent holes which allow the ionizing gases generated in each phase compartment to be channeled through the arc extinguishers and discharged out dedicated vents, formed in the circuit breaker cover on the line side of the circuit breaker.

It is also important to minimize communication of the ionizing gases between adjacent the line side terminals, generally disposed outside the circuit breaker housing. More specifically, the line side conductors are received in openings in one wall of the housing such that the line side terminals extend outwardly therefrom. In order to prevent communication of the ionizing gases between adjacent line side terminals, exterior interphase gas barriers are provided. Removable line terminal covers are also provided which, in addition to allowing access to the line terminals, also act as interphase gas barriers adjacent the vents through which the ionizing gases are discharged in the circuit breaker cover.

Moreover, due to the difference in potential between the line conductor and the movable contact arm assembly after the main contacts open, it is also necessary to reduce the amount of ionizing gases that communicate therebetween, particularly where the separation between the line conductor and the movable contact arm assembly is the smallest to prevent flashover. Lastly, it is necessary to seal the interfaces within the phase compartments between the line conductor and the housing in order to prevent communication of the ionizing gases between phases and between phases and grounded components, such as the panelboard, which carries the circuit breaker. These interfaces include the openings in the wall of the housing through which the line conductor extends and the wall of the housing to which the line conductor is secured. It is known in the art to seal such interfaces as well as form a gas barrier between the line conductor and the movable contact arm with amorphous sealing compounds, such as SIKAFLEX-221, available from R.R.B. Plastics in Waldron, Ind. or RTV, available from the hand. Not only is such a process time-consuming which leads to increased labor costs, but it is difficult to obtain consistent results. Moreover, although proper application of the sealant can provide an effective gas seal and barrier, improper application by less experienced personnel can lead to an ineffective seal or barrier which can result in a circuit breaker failure.

SUMMARY OF THE INVENTION

It is an object of the present invention to provide means for segregating conductive gases generated as a result of a circuit interruption which solves the problems of the prior art.

It is yet another object of the present invention to provide a gas seal for a line conductor which can be consistently applied.

Briefly, the present invention relates to a molded gasket for a line conductor in a circuit breaker which acts as a gas seal and a gas barrier to prevent conductive ionizing gases resulting from a circuit interruption from flashing over and causing phase-to-phase and phase-to-ground faults. The molded gasket includes provisions for sealing the line conductor at the interfaces with the housing as well as providing a gas barrier for the movable contact arm.

DESCRIPTION OF THE DRAWING

These and other objects and advantages of the present invention will become readily apparent upon consideration of the following detailed description and attached drawing wherein.

DETAILED DESCRIPTION

As illustrated and described herein, a Westinghouse Series C, L-frame molded case circuit breaker will be described. However, it should be understood that the principles of the present invention are applicable to various types of molded case circuit breakers.

Figure 3:
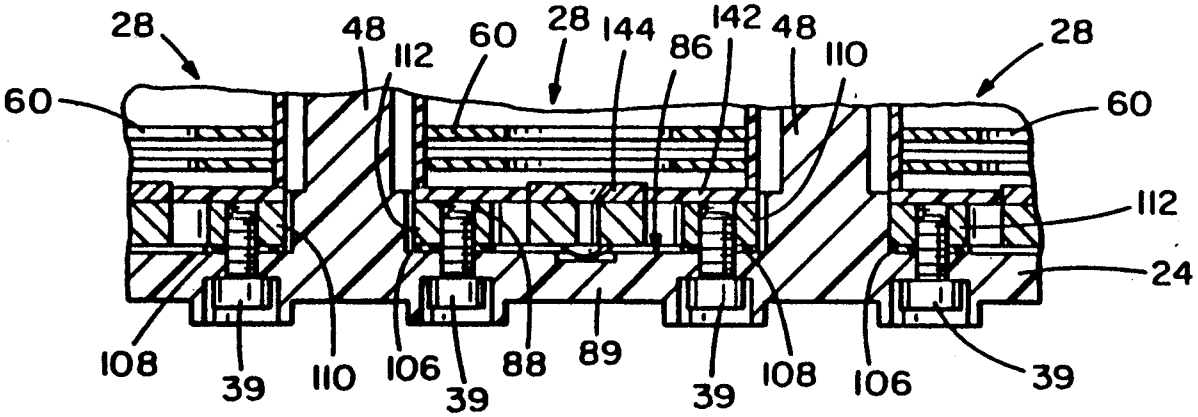
FIG. 3 is a partial cross-sectional view along line 3—3 of FIG. 2.
Figure 5:
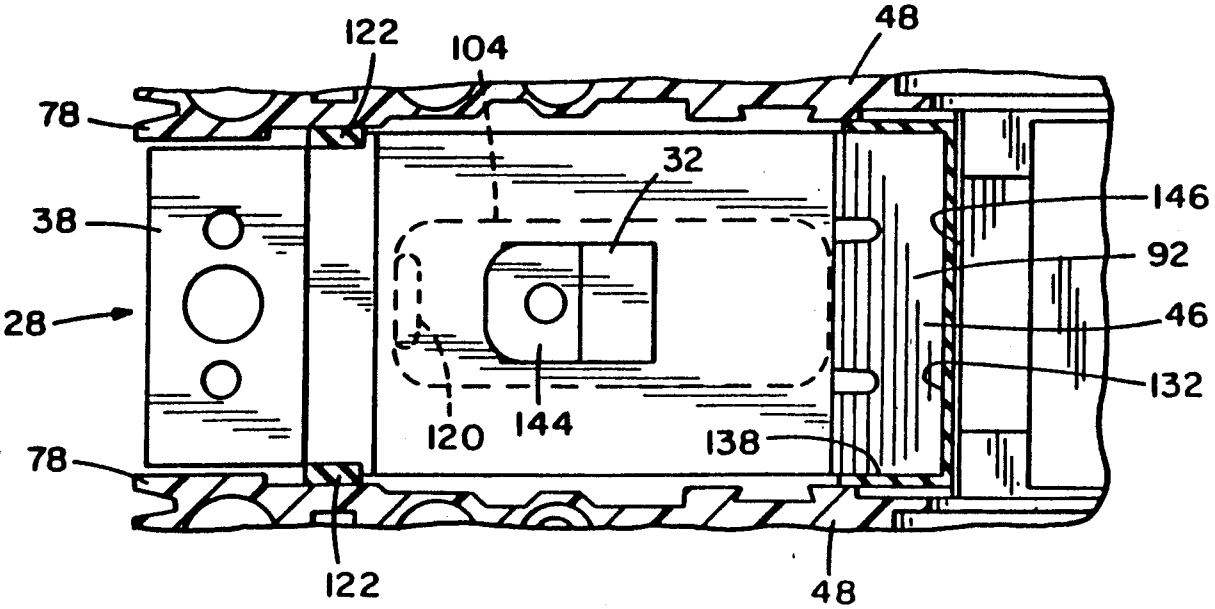
FIG. 5 is a partial plan sectional view along line 5—5 of FIG. 2.
Figure 4:
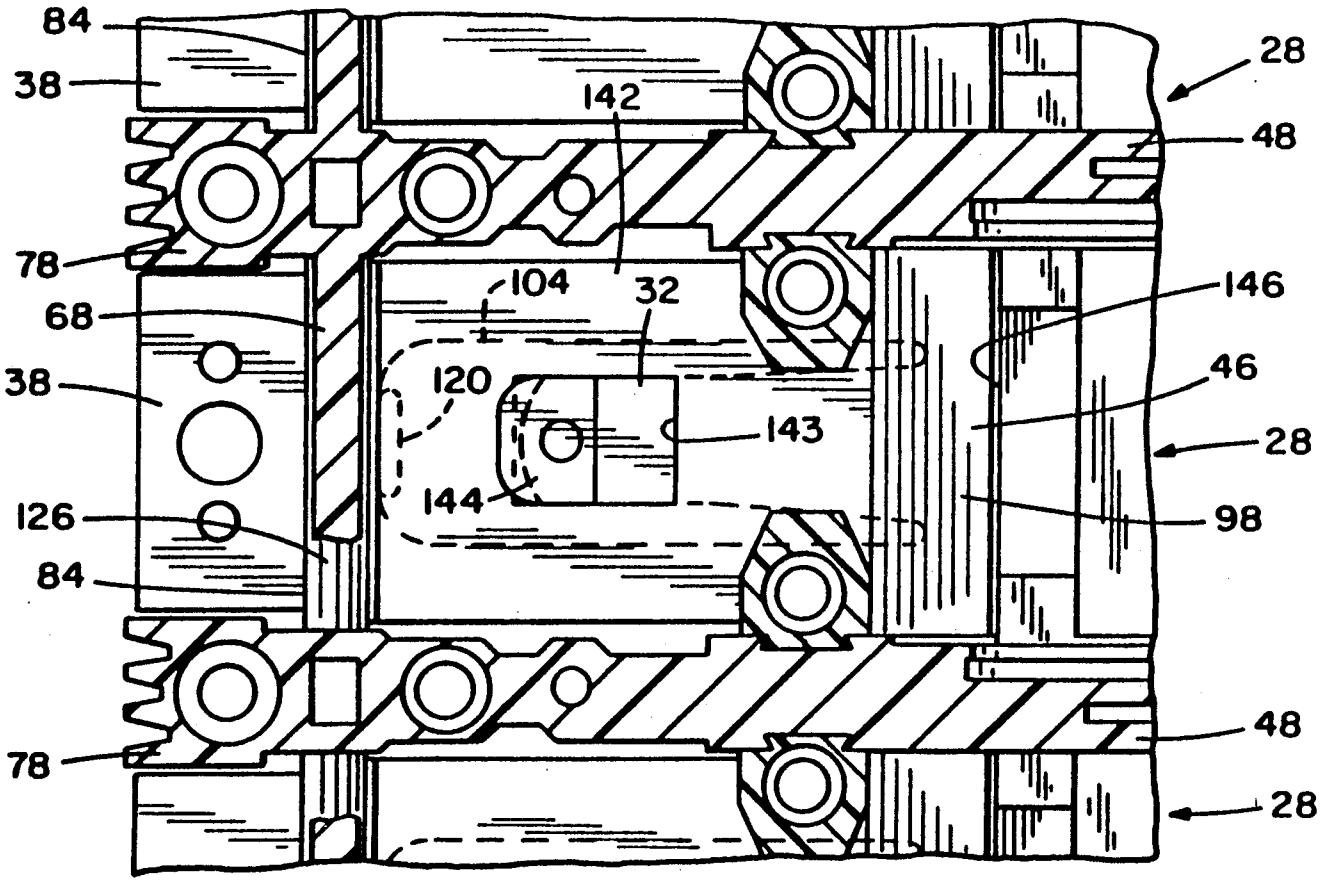
FIG. 4 is a partial plan sectional view along line 4—4 of FIG. 2.

A molded case circuit breaker, generally indicated by the reference numeral 20, comprises an electrically insulated housing 22 having a molded base 24 and a molded coextensive cover 26. As will be discussed below, the internal cavities of the molded base 24 are segregated by pole defining phase compartments 28 (FIGS. 3–5).

A pair of separable main contacts 30 are carried in each phase compartment 28. More specifically, the pair of main contacts 30 (FIG. 2) include a rigidly mounted main contact 32 and a movably mounted main contact 34. The rigidly mounted main contact 32 is mounted to a line side conductor 36 having a line side terminal portion 38 (FIGS. 2, 4 and 5) at one end. The line side terminal portion 38 extends outwardly from the housing 22 to permit connection with an external electrical circuit. The line side conductor 36 is attached to the base 24 with a plurality of fasteners 39 (FIG. 3).

The movable main contact 34 (FIG. 2) is carried by a contact arm assembly 40. The contact arm assembly 40 is connected to a load conductor assembly 42. An operating mechanism 44 is provided for opening and closing the contact arm assembly 40. A detailed description of the operating mechanism 44 as well as the entire circuit breaker 20 is provided in U.S. Pat. No. 4,973,927, assigned to the same assignee as the present invention, hereby incorporated by reference.

LINE CONDUCTOR GASKET

Figure 6:
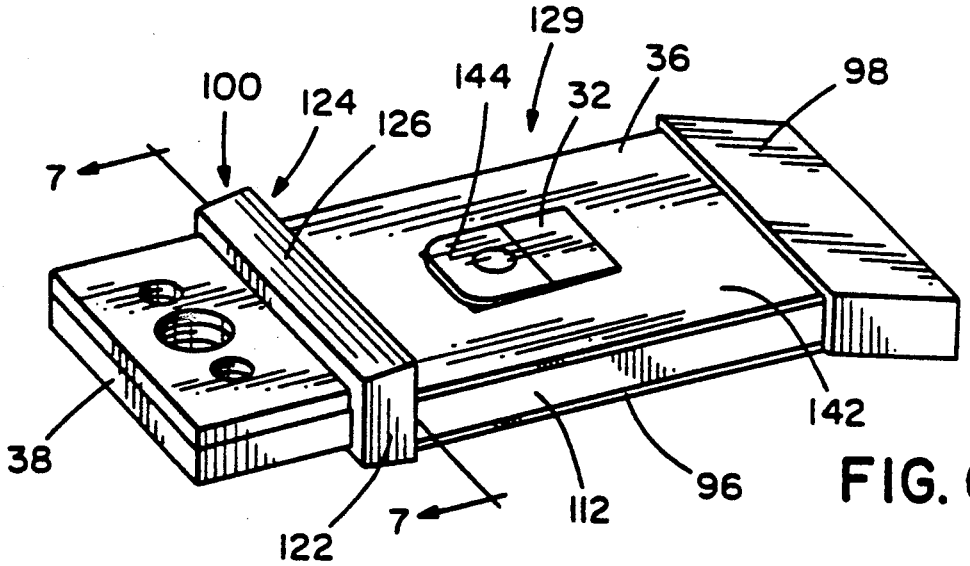
FIG. 6 is a perspective view of the gasket in accordance with the present invention assembled to a line conductor.
Figure 7:
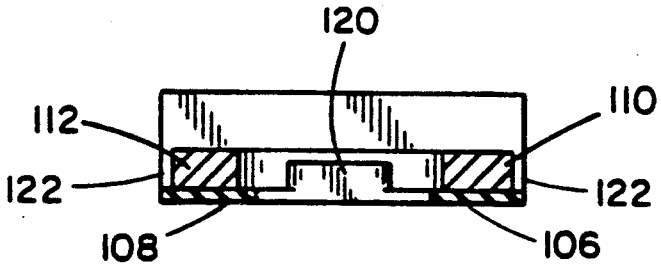
FIG. 7 is a partial sectional view along line 7—7 of FIG. 6.
Figure 8:
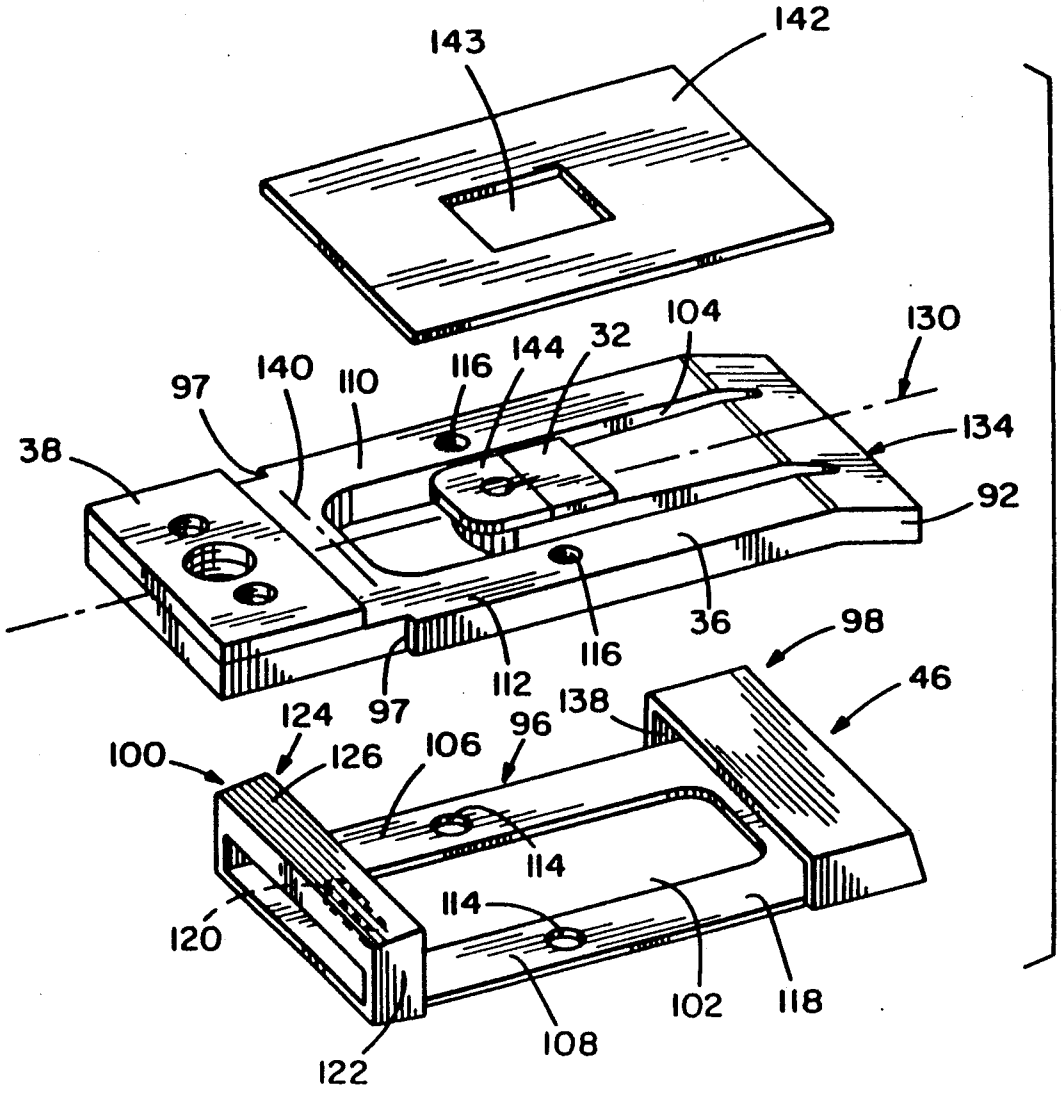
FIG. 8 is an exploded perspective view of the assembly shown in FIG. 6.

An important aspect of the invention relates to a line conductor gasket 46, best shown in FIGS. 6–8. This gasket 46 assists in preventing conductive ionizing gases, resulting from a circuit interruption (e.g., opening of the main contacts 30) from flashing over and causing phase-to-phase and phase-to-ground faults. More specifically, opening of the main contacts 30, particularly during overcurrent conditions, such as a short circuit, generates ionizing gases. These ionizing gases are generated adjacent the main contacts 30 in each pole. Since the ionizing gases are conductive, these gases must be segregated. Therefore, the circuit breaker base 24 and cover 26 are provided with interphase gas barriers, which include integrally formed sidewalls 48 in the base 24 (FIGS. 1, 3, 4, 5) and aligned sidewalls 50 in the cover 26 (FIG. 1) to define the phase compartments 28.

Figure 1:
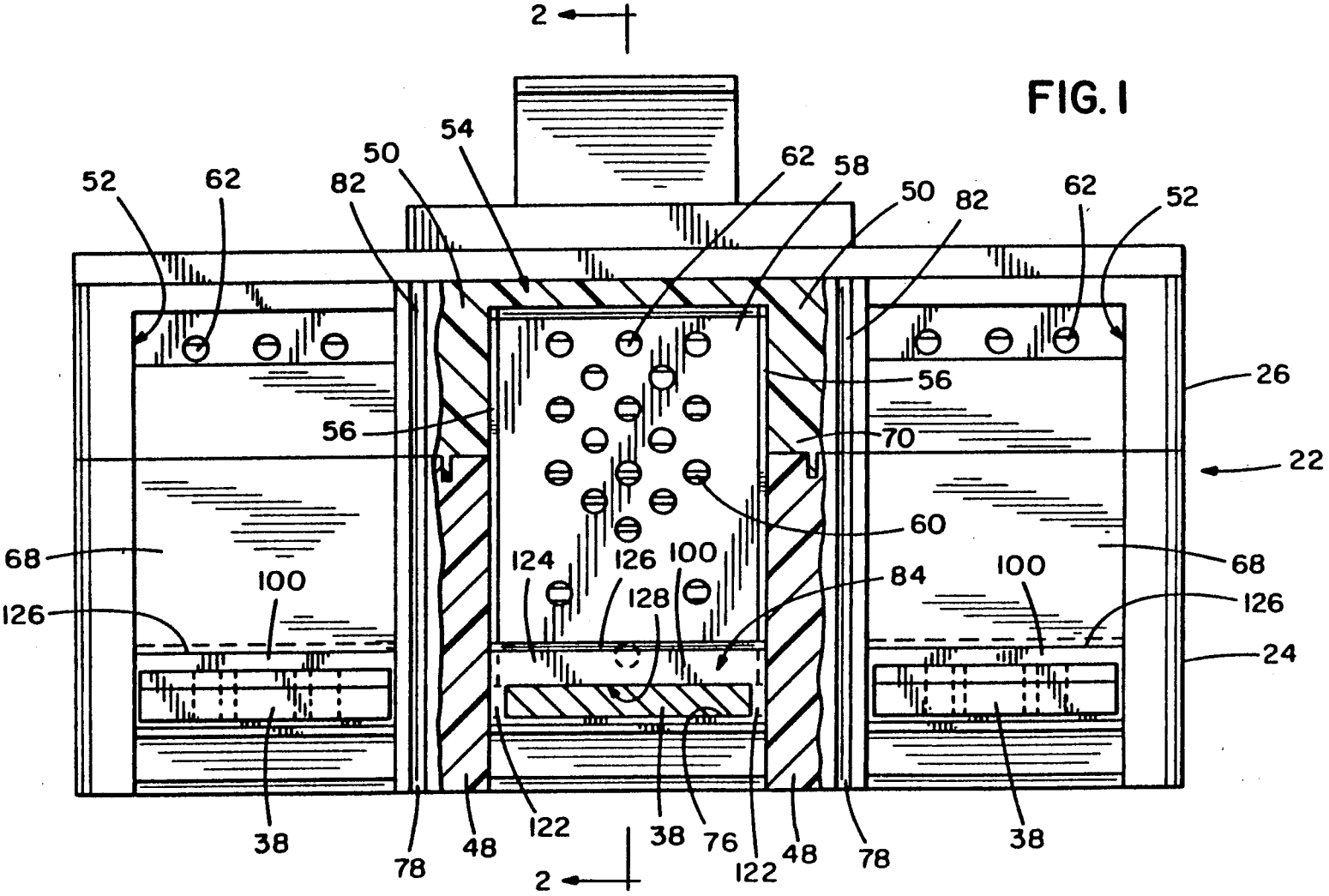
FIG. 1 is an end elevational view of a molded case circuit breaker with the center pole partially broken away.

The conductive gases are exhausted out vents 52 (FIGS. 1 and 2), formed in the circuit breaker cover 26 for each phase compartment 28 after being directed through an arc extinguisher 54 (FIGS. I and 2). Each arc extinguisher 54 is formed with a pair of spaced apart sidewalls 56 and front wall 58 for carrying a plurality of generally parallel arc extinguishing plates 60 and a top plate 61, known as an arc horn. The front wall 58 is provided with a plurality of vent holes 62 (FIG. 1). These vent holes 62 allow the ionizing gases for each pole to communicate with a cavity 64 (FIG. 2), formed between the front wall 58 of the arc extinguisher 54 and an interior surface 66 (FIG. 2), formed by aligned wall portions 68 and 70 of the base 24 and the cover 26, respectively. Since the cavity 64 is in flow communication with the vents 52, this allows the ionizing gases to be exhausted out of the line side of the circuit breaker 20. A polyester barrier 72 (FIG. 2) is disposed between the arc horn 61 and an adjacent plate 60 to close the top portion of the arc extinguisher 54 to reduce the amount of ionizing gases that contact the cover 26.

As previously discussed, terminal portions 38 of the line conductors 36 extend outwardly from the base 24 through an opening 76 (FIG. 1) in the wall 68 to permit connections to an external electrical circuit. In order to prevent a flashover by the ionizing gases between adjacent terminal portions 38, the exterior of the base 24 is provided with a pair of exterior spaced apart sidewalls 78 (FIG. 1, 3 and 4), which act as interphase gas barriers between adjacent terminal portions 38.

Additionally, a removable line terminal cover 80 is provided. The line terminal cover 80 (FIG. 2) allows access to the terminals 38 as well as provides interphase gas barriers for the cover 26 adjacent the vents 52. More specifically, the line terminal cover 80 is formed with a pair of spaced apart sidewalls 82 (FIG. 1), adapted to be aligned with the sidewalls 78, formed in the base 24 to form a continuous interphase gas barrier adjacent the terminal portions 38 of the circuit breaker 20.

In order to prevent phase-to-phase and phase-to-ground flashovers resulting from the ionizing gases, it is also necessary to seal the interfaces between line conductor 36 and the base 24 to prevent ionizing gases from escaping. One interface 84 (FIGS. 1 and 2) is around the line side conductor 36 within the opening 76 in the base wall 68. Another interface 86 (FIG. 3) is around apertures 88, formed in the wall 89 in the base 24, which receive the fasteners 39 to secure the line conductor 36 to the base 24. Leakage of ionizing gases through the apertures 88 could result in a phase to ground flashover.

Additionally, it is necessary to reduce the amount of ionizing gases which come in contact with the contact arm assembly 40. More specifically, when the main contacts 30 are opened, the line conductor 36 and the contact arm assembly 40 are at different potentials. Because of the relatively small clearance between certain points on the contact arm assembly 40, for example, the area 90 (FIG. 2) and a tapered portion 92 of the line conductor 36, it is necessary to provide a gas barrier to prevent flashover.

Heretofore, the interfaces 84 and 86 have been sealed with amorphous sealing compounds, such as SIKA-FLEX-221 and RTV. Such amorphous sealing compounds have also been used to form gas barriers for the line conductor 36. While such sealing compounds provide adequate gas seals and a gas barrier when applied properly, the process for applying such sealing compounds may result in inconsistent applications. In other words, the effectiveness of the seal by such a process is largely related to the experience of the person applying it. Therefore, there is virtually no way to ensure consistent application.

In order to solve this problem, a line conductor gasket 46 in accordance with the present invention is provided. The line conductor gasket 46 is adapted to provide a consistent seal for the interfaces 84 and 86 between and the line conductor 36 and the base 24 as well as form a gas barrier to reduce the amount of ionizing gases that contact portions of contact arm assembly 40.

The line conductor gasket 46, in accordance with the present invention, may be formed as single molded member from a non-conductive material, such as black urethane ATSM D2000 AA 410. Moreover, the line conductor gasket 46 may be molded separately as shown in FIG. 8 and installed on the line conductor 36 as shown in FIG. 6. It is also contemplated that the line conductor gasket 46 can be molded around the line conductor 36.

As best shown in FIG. 8, the line conductor gasket 46 includes three portions; a fastener seal portion 96, a contact arm gas barrier portion 98 and an opening seal portion 100. The fastener seal portion 96 is adapted to seal around the apertures 88 in the base 24 and is formed in a generally rectangular shape. A centrally disposed aperture 102 is provided in the fastener seal portion 96 and is adapted to be generally aligned with a U-shaped slot 104, formed in the line conductor 36. The aperture 102 in the line conductor gasket 46 defines two spaced apart elongated leg portions 106 and 108. These leg portions 106 and 108 are formed with a width either equal to or slightly greater than the width of leg portions 110 and 112 of the line conductor 36. A pair of apertures 114 are provided in the leg portions 106 and 108 of the line conductor gasket 46. These apertures 114 are adapted to be aligned with apertures 116 in the line conductor 36 and the apertures 88 in the base 24 to allow the line conductor 36 to be secured to the base 24 with the fasteners 39.

One side 118 (e.g., the side that contacts the line conductor 36) of the fastener seal portion 96 is provided with a locating tab 120. The locating tab 120 is disposed generally perpendicular to the plane of the wall seal portion 96. This locating tab 120 is used to help locate the fastener seal portion 96 relative to the slot 104 and the apertures 116 in the line conductor 36.

The opening seal portion 100 is adapted to seal the line conductor 36 relative to the opening 76 provided in the wall 68 of the base 24. This portion 100 is formed with a pair of spaced apart generally wedge-shaped leg portions 122, disposed adjacent opposing edges of the fastener seal portion 96 and disposed generally perpendicular to the plane of the fastener seal portion 96. These leg portions 122 are adapted to engage stepped surfaces 97, formed in the line conductor 36.

Figure 2:
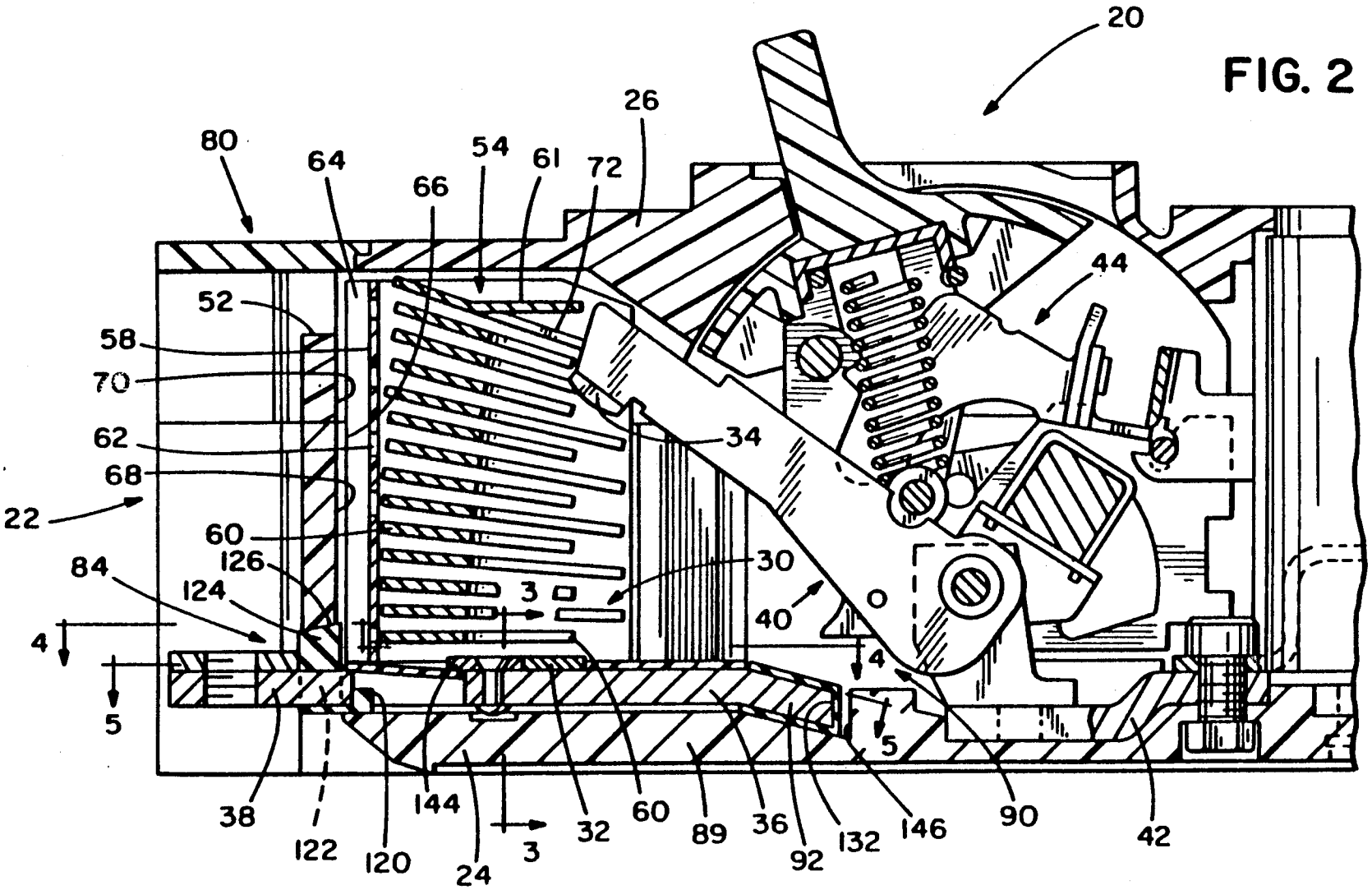
FIG. 2 is a cross-sectional view along line 2—2 of FIG. 1 with the movable contact arm assembly shown in a blown open position.

A connecting portion 124 connects the leg portions 122 to form a seal for the interface 84 around the line conductor 36 within the opening 76 in the wall 68. The connecting portion 124 may be formed as a wedge, for example, with a generally trapezoidal cross-section defining a sloped surface 126 as best shown in FIGS. 2 and 8. The sloped surface 126 is adapted to be wedged against an upper edge 128 (FIG. 1) of the opening 76 to form a relatively tight seal.

The contact arm gas barrier portion 98 may be formed as a boot, adapted to fit relatively snugly over the downwardly tapered portion 92 of the line conductor 36. The boot 98 acts as a gas barrier to reduce the amount of ionizing gases that contact the contact arm assembly 40 adjacent the area 90 to reduce the possibility of flashover.

Since the line conductor gasket 46 is formed from a generally flexible material, there is no need to mold the gasket 46 to conform to the tapered portion 92 of the line conductor 36. This allows the gasket 46 to be rather easily and quickly installed on the line conductor 36 along with an insulation barrier (discussed below) to form an assembly 129.

Moreover, the gasket 46 is relatively easy to align with the line conductor 36 and is adapted to generally retain its position relative to the line conductor 36 to facilitate installation of the assembly 129 (FIG. 6) into the circuit breaker 20. More specifically, the boot forming the contact arm gas barrier portion 98 together with the leg portions 122 of the opening seal portion 100 position the gasket 46 with respect to a longitudinal axis 130 of the line conductor 36. An interior wall 132 (FIG. 2) of the boot will generally fit snugly against an inwardly disposed edge 134 (FIG. 8) of the line conductor 36. The leg portions 122 are adapted to be held against the stepped surfaces 97, formed in the line conductor 36, to locate the gasket 46 as well as reduce, if not totally prevent, movement of the gasket 46 relative to the line conductor 36 when the assembly 129 is installed in the circuit breaker 20. As previously mentioned, the locating tab 120 (FIGS. 7 and 8) facilitates locating the gasket 46 relative to the U-shaped slot 104 in the line conductor 36. Interior sidewalls 138 (FIG. 8) of the boot as well as the arrangement of leg portions 122 relative to the stepped surfaces 97, reduce the possibility of movement relative to the line conductor 36 along a transverse axis 140.

Before the gasket 46 and line conductor 36 is assembled, an insulation barrier 142, formed from, for example, a glass polyester material is installed. The insulation barrier 142 is provided with an aperture 143 for receiving the main contact 32 and an arc runner 144. The insulating barrier 142 is adapted to cover portions of the line conductor 36 which would otherwise be exposed after the line conductor gasket 46 is installed.

After the insulation barrier 142 is installed and the gasket 46 is placed on the line conductor 36, the assembly 129 is then inserted into the circuit breaker 20 with the terminal portion 38 of line conductor 36 inserted through the opening 76 from the inside of the circuit breaker 20. The terminal portion 38 is pushed through the opening 76 until the tapered portion 92 of the line conductor 36 is able to be seated relative to a locating wall 146 (FIG. 2) in the base 24. The sloped surface 126 in the opening seal portion 100 is then wedged against the upper edge 128 of the opening 76 to provide a relatively snug fit. The line conductor 36 is then fastened to the base 24 by way of the fasteners 39 to provide a seal for the interfaces 84 and 86 as well as provide a gas barrier relative to the contact arm assembly 40. The remaining components of the circuit breaker 20 are then installed.

Obviously, many modifications and variations of the present invention are possible in light of the above teachings. Thus, it is to be understood that, within the scope of the appended claims, the invention may be practiced otherwise than as specifically described hereinabove.

What is claimed and desired to be secured by a Letters Patent is:

1. A molded case circuit breaker comprising:

a housing which includes a base portion, said base portion including a first wall with an opening and a second wall;

one or more pairs of separable main contacts disposed in said base portion;

a line conductor defining a terminal portion for connection to an external electrical circuit, coupled to one of said separable main contacts, said line conductor received in said opening in said first wall defining a first interface and disposed adjacent said second wall defining a second interface;

a load conductor coupled to the other of said separable main contacts;

an operating mechanism, operatively coupled to said one or more pairs of separable main contacts; and a first molded gasket for providing a gas seal between said line conductor and said first interface.

2. A circuit breaker as recited in claim 1, wherein said second wall is provided with one or more apertures for receiving fasteners for securing said line conductor to said second wall further defining said second interface.

3. A circuit breaker as recited in claim 2, further including a second molded gasket for providing a gas seal between said line conductor and said second interface.

4. A circuit breaker as recited in claim 3, further including a gas barrier adapted to be disposed on an end of the line conductor opposite the terminal portion.

5. A circuit breaker as recited in claim 4, wherein said gas barrier is molded.

6. A circuit breaker as recited in claim 5, wherein said gas barrier is formed as a boot.

7. A circuit breaker as recited in claim 3, wherein said first molded gasket and second molded gasket are integrally formed as a single molded member.

8. A circuit breaker as recited in claim 4, wherein said first molded gasket, second molded gasket and the gas barrier are integrally formed as a single molded member.

9. A circuit breaker as recited in claim 8, wherein said single molded member is formed from a relatively flexible material.

10. A circuit breaker as recited in claim 7, wherein said single molded member is formed from a non-conductive material.

11. A circuit breaker as recited in claim 7, wherein said single molded member is formed from urethane.

12. A circuit breaker as recited in claim 1, wherein said first molded gasket includes means for wedging a portion of said first molded gasket in said opening.

13. A circuit breaker as recited in claim 8, further including means for positioning said first molded gasket, second molded gasket and gas barrier relative to said line conductor.

14. A circuit breaker as recited in claim 13, further including means for maintaining the position of said first molded gasket, second molded gasket and gas barrier while said line conductor is being installed in said breaker.

15. A molded case circuit breaker comprising:

a housing, which includes a base portion, said base portion including a first wall with an opening and a second wall with one or more apertures;

one or more pairs of separable main contacts disposed in said base portion;

a movably mounted contact arm for carrying one of said main contacts in said pair;

a first conductor electrically coupled to one of said operable main contacts;

a second conductor coupled to the other contact in said pair of separable main contacts, said second conductor received in said opening in said first wall defining a first interface, said second conductor provided with one or more apertures adapted to be aligned with said apertures in said second wall to receive fasteners to secure said second conductor to said second wall defining a second interface;

an operating mechanism, operatively coupled to said movably mounted contact arm; and a molded gasket which includes a wall opening seal portion for sealing said first interface.

16. A circuit breaker as recited in claim 15, wherein said molded gasket further includes a fastener seal portion for sealing said second interface.

17. A circuit breaker as recited in claim 15, wherein said molded gasket further includes a contact arm gas barrier portion for reducing the amount of ionizing gases resulting from a circuit interruption from contacting a portion of said movably mounted contact arm.

18. A circuit breaker as recited in claim 15, wherein said gasket includes means for positioning said gasket relative to said second conductor.

19. A circuit breaker as recited in claim 18, wherein said positioning means includes means for maintaining the position of said gasket relative to the second conductor while the second conductor is being installed in the circuit breaker.

20. A process for providing a gas seal for a line conductor in a molded case circuit breaker comprising the steps of:

(a) defining interfaces relative to the line conductor that require sealing to prevent ionizing gases resulting from a circuit interruption from flashing over; and (b) molding a gasket from a non-conductive material that is adapted to seal said interfaces when the line conductor is installed in the circuit breaker.

21. A process as recited in claim 20, wherein said gasket is molded apart from said line conductor.

22. A process as recited in claim 20, wherein said non-conductive material is relatively flexible and adapted to conform to the shape of said line conductor.

* * * * *